US005084969A

United States Patent [19]

Althaus

[11] Patent Number: 5,084,969

[45] Date of Patent: Feb. 4, 1992

[54] RAZOR HEAD OF A WET RAZOR

[75] Inventor: Wolfgang Althaus, Wuppertal, Fed. Rep. of Germany

[73] Assignee: Wilkinson Sword Gesellschaft mit Beschränkter Haftung, Solingen, Fed. Rep. of Germany

[21] Appl. No.: 577,255

[22] Filed: Aug. 31, 1990

[51] Int. Cl.[5] ..... B26B 21/00

[52] U.S. Cl. ..... 30/79; 30/50; 30/77

[58] Field of Search ..... 30/50, 54, 60, 61, 63, 30/71, 77, 79, 80, 47, 48, 49, 41

[56] References Cited

U.S. PATENT DOCUMENTS

| | | | |
|---|---|---|---|
| 2,038,230 | 4/1936 | McWilliams | 30/61 |
| 2,333,743 | 11/1943 | Sampson | 30/60 |
| 2,492,328 | 12/1949 | Simon et al. | 30/61 |
| 2,710,446 | 6/1955 | Seko | 30/49 |
| 3,500,539 | 3/1970 | Muros | 30/40.1 |
| 3,909,941 | 10/1975 | Bowman et al. | 30/47 |
| 4,063,354 | 12/1977 | Oldroyd et al. | 30/47 |
| 4,253,236 | 3/1981 | Jacobson | 30/47 |
| 4,266,340 | 5/1981 | Bowman | 30/50 |
| 4,335,508 | 6/1982 | Francis et al. | 30/47 |
| 4,347,663 | 9/1982 | Ullmo | 30/47 |
| 4,378,633 | 4/1983 | Jacobson | 30/50 |
| 4,501,067 | 2/1985 | Duncan | 30/63 |
| 4,624,051 | 11/1986 | Apprille, Jr. et al. | 30/41 |
| 4,932,123 | 6/1990 | Francis | 30/77 |

FOREIGN PATENT DOCUMENTS

| | | |
|---|---|---|
| 2323502 | 4/1977 | France . |
| 2009017 | 6/1979 | United Kingdom . |

*Primary Examiner*—Frank T. Yost
*Assistant Examiner*—Hwei-Siu Payer
*Attorney, Agent, or Firm*—Robert W. Becker & Associates

[57] ABSTRACT

A razor head is provided that is disposed at the front end of a handle of a wet razor. The razor head includes a body in which is disposed a single or double razor blade. A guide strip that extends parallel to the razor blade is disposed in front of the same and is furthermore disposed on a displacement mechanism or a pivot mechanism in such a way that in a direction perpendicular to a lengthwise dimension of the guide strip, the latter is freely movable counter to a spring force. This allows the shaving angle and hence the cutting geometry to be altered in a straighforward manner.

15 Claims, 1 Drawing Sheet

RAZOR HEAD OF A WET RAZOR

BACKGROUND OF THE INVENTION

The present invention relates to a razor head that is disposed at the front end of a handle of a wet or safety razor, and includes a body in which is disposed a razor blade means in the form of a single or double razor blade; a guide strip that extends parallel to the cutting edge or edges of the razor blade or blades is disposed in front of the same, and a protective cover or cap is disposed behind the cutting edge or edges.

A razor head of this general type for a wet razor is known and is basically disposed at the front end of a handle. A single or double razor blade is disposed in a body of the razor head and is covered by a protective cover, with a guide strip that extends parallel to the cutting edges of the razor blades being disposed in front of these cutting edges.

The shaving angle of such a razor head is defined by the front guide strip, the rear protective cover, and by the cutting edges of the razor blades, to the extent that the latter is a double razor blade. However, since these components are fixedly interconnected, such a razor head has a very specific shaving angle upon which the shaving characteristics depend. Thus, the shaving characteristics of a specific razor head are always the same. However, this is a drawback since the user would often like to change the razor geometry in conformity with his particular needs.

It is therefore an object of the present invention to improve a razor head of the aforementioned general type in such a way that it is possible in a technically straightforward manner to alter the shaving angle, and hence the cutting geometry, via the razor head.

BRIEF DESCRIPTION OF THE DRAWING

This object, and other objects and advantages of the present invention will appear more clearly from the following specification in conjunction with the accompanying schematic drawing, in which.

SUMMARY OF THE INVENTION

Figure 1:
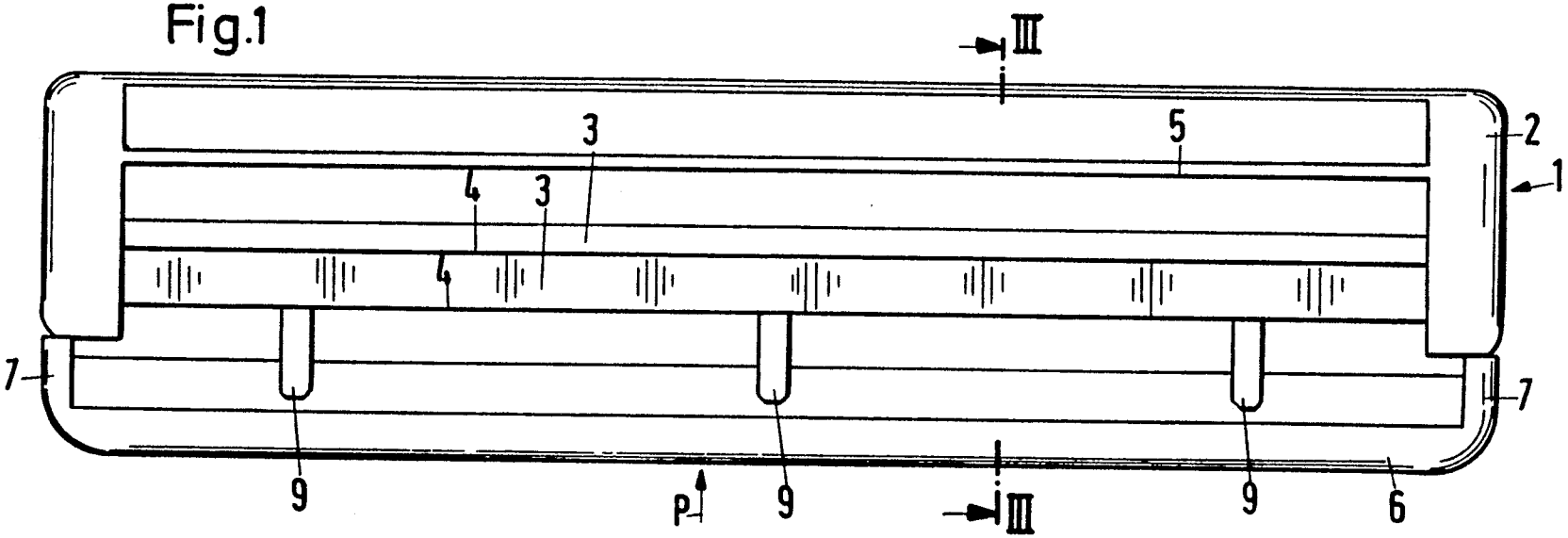
FIG. 1 is a plan view of a first exemplary embodiment of the inventive razor head in the form of a so-called razor blade unit.

The razor head of the present invention is characterized primarily in that an adjustment mechanism, in the form of a displacement or pivot mechanism, is provided on which the guide strip, in a direction perpendicular to a lengthwise dimension of the guide strip, is disposed so as to be freely movable counter to a spring force.

By means of a razor head that is constructed pursuant to the present invention, it is possible in a technically straightforward manner to alter the shaving angle and hence the cutting geometry. This is achieved pursuant to the present invention in that in conformity with the pressure applied by the user while shaving, the guide strip is moved, thereby enabling a simple alteration of the shaving angle. The greater the movement of the guide strip, the greater is the change of the shaving angle. If the pressure is relaxed, the guide strip returns to its starting position, with the original cutting geometry, as a consequence of the spring force.

Pursuant to one advantageous specific embodiment of the present invention, it is proposed that as the pressure upon the guide strip during shaving increases, the amount by which the cutting edge or edges of the razor blade or blades project beyond the imaginary tangential plane that rests against the top of the guide strip and the protective cover increases, whereby the distance between the cutting edge or edges and the contact edge of the guide strip essentially remains the same or decreases. By means of the principle proposed by the present invention, when pressure is applied the guide strip is moved parallel to the transverse axis of the razor blades, with the result that due to the increasing pressure upon the guide strip, the projection of the razor blade, and hence the thoroughness of the shave, is increased. Since at the same time the distance of the tip of the blade to the contact edge of the guide strip remains constant or decreases, a uniform shaving characteristic is realized while shaving.

Pursuant to a further specific embodiment of the present invention, it is proposed that the guide strip and the spring mechanism, i.e. the adjustment mechanism, be operationally independent of the arrangement of the razor blade or blades in the body. As a result, the deflection of the guide strip is achieved by the blade unit without any complicated mechanical means, so that the blade unit along with the single or double razor blade that is disposed in the body can, for example, be fixedly secured, and the operation of the guide strip is independent of the connection of the blade unit.

Pursuant to a first embodiment, the guide strip is disposed on the adjustment or displacement mechanism in such a way as to be movable essentially linearly.

In a first alternative the plane of movement of the guide strip extends essentially parallel to the plane or planes of the razor blade or blades. In so doing, on the one hand a shifting or displacement of the guide strip can be achieved in a technically straightforward manner, and on the other hand the displaceability of the guide strip essentially parallel to the plane of the razor blade has the advantage that this requires a minimum expenditure of force since the direction for the force application that is necessary to displace the guide strip essentially coincides with the direction of shaving. In this connection, the further the guide strip is moved in the direction of the body, and hence in the direction of the razor blades, in conformity with the pressure that is applied, the greater becomes the shaving angle. Thus, the greater the user presses the guide strip of the razor head upon the skin that is being shaved, the greater is the shaving angle that can be established.

In a second alternative, the plane of movement of the guide strip extends essentially perpendicular to the plane or planes of the razor blade or blades. If in this arrangement pressure is applied to the guide strip during shaving, the guide strip is displaced downwardly against the spring force in such a way that the shaving angle increases.

In a third alternative, with a double razor blade, the plane of movement of the guide strip extends essentially perpendicular to the connecting plane of the cutting edges of the razor blades. Here also via an appropriate movement of the guide strip counter to the spring force during shaving, the shaving angle can be increased in that the guide strip deflects at an angle downwardly and toward the rear.

Pursuant to a further embodiment of the present invention, it is proposed that the spring force that is exerted upon the guide strip be effected by at least one separate spring. This spring can, for example, be a coil spring. The springs are disposed as separate components between the body and the guide strip. The installed springs thereby permit a precise determination of the displacement forces.

Pursuant to one preferred structural embodiment of the displacement mechanism, the guide strip is provided with at least two pins via which the guide strip is mounted in the body in such a way as to be linearly movable, with the springs being disposed within the body and each being supported between the body and the free rear ends of the pins. In the situation where pursuant to the first alternative described above the plane of movement of the guide strip extends essentially parallel to the plane or planes of the razor blade or blades, the pins are disposed in the vicinity of the back side of the guide strip. Where the movement of the guide strip is as described in conjunction with the two other alternatives, it is possible to provide in place of the pins appropriate displacement means that carry out the desired purpose in an equivalent manner.

Pursuant to a second specific embodiment regarding the movability of the guide strip, this guide strip is pivotably mounted on a pivoting mechanism, the pivot axis of which is disposed in the body. In this manner also it is possible to adjust the shaving angle while shaving when appropriate pressure is applied to the upper side of the guide strip, so that the guide strip can be pivoted downwardly against the spring force accompanied by enlargement of the shaving angle. In this connection, the guide strip can have arms that extend toward the rear and that are rotatably mounted in the body, with the thus-formed lever arrangement being brought into a starting position by the springs.

Pursuant to one specific embodiment, each of the springs is embodied as a compound spring, especially double springs that have different spring characteristics. This results in the advantage that at the start of the shaving process, and the application of a small force, the guide strip is first moved into an operating position in which a gentle shave is possible, since an appropriate shaving angle has been established. If the force is then increased in order to obtain a thorough shave, the force of a second (stronger) spring must be overcome, which then leads to a different shaving angle. This path of movement must be held within narrow limits.

The effect described above can also be achieved if the spring itself has a very specific characteristic, and if in addition the guide strip is made of an elastic material, the spring characteristic of which differs from the characteristic of the springs. This elastic material of the guide strip then permits the second movement for the razor geometry having the more thorough shave.

In order to limit the movement of the guide strip, stop means are provided between the body and the guide strip.

In order to ensure a satisfactory displacement of the guide strip relative to the body of the razor head, movement or displacement guides are preferably provided between the body and the guide strip.

Pursuant to one preferred structural embodiment of the present invention, the stop means and/or the movement guides are disposed laterally on the razor head.

Pursuant to a further specific embodiment of the present invention, the razor head is provided with a friction-reducing glide strip, especially one having a water soluble or insoluble polymer base.

The inventive razor head with its movable guide strip can be utilized on any type of wet razor; for example, the razor blades can be replaceable. However, pursuant to one preferred specific embodiment, the razor head is formed by a razor blade unit where the razor blade or blades are fixedly embedded in a plastic body, with the guide strip being disposed in such a way that it is movable relative to this plastic body.

Further specific features of the present invention will be described in detail subsequently.

DESCRIPTION OF PREFERRED EMBODIMENTS

Referring now to the drawing in detail, in the illustrated embodiment the razor blade unit 1 comprises a plastic body 2 in which are fixedly embedded two razor blades 3 in the form of a double razor blade. The cutting edges 4 of the two razor blades 3 extend parallel to one another and are staggered one behind the other. At the top, the razor blades 3 are partially covered by a protective cover 5. The razor blade unit 1 is intended to be disposed at the front end of a non-illustrated handle of a wet or safety razor, with the securing mechanism that is provided on the razor blade unit 1 for this purpose not being shown.

A guide strip 6, which is also made of plastic, is disposed in front of the cutting edges 4 of the razor blades 3 and below the plane formed by the lowermost razor blade 3. The guide strip 6 is provided with lateral wings 7 that extend toward the rear. However, of greatest importance is the fact that the guide strip 6 is provided with a displacement mechanism 8 via which the guide strip 6 can be shifted in a direction toward the body 2. For this purpose, the back of the guide strip 6 is provided with, for example, three pins 9 that project into appropriate recessed portions 10 in the body 2. Provided at the free end of each of the pins 9 is a respective disk-like head 11 that prevents the pins 9, and hence the guide strip 6, from being pulled out of the recessed portion 10 in the body 2 For each pin 9 there is disposed between the base of the recessed portion 10 and the disk-like head 11 a double spring means comprised of two springs 12' and 12''. These two springs have different spring characteristics, with the spring 12' having a lower spring constant than does the spring 12'', so that the spring 12' can be pressed in over a certain distance with a lesser force than would be needed to press in the spring 12'' over the same distance.

The razor blade unit of FIGS. 1-3 operates as follows.

The razor geometry and shaving angle are defined by the guide strip 6, the cutting edges 4 of the razor blades 3, and the protective cover 5. In the starting position illustrated in FIG. 3, this shaving angle is relatively small.

While shaving, the user presses the guide strip 6 of the razor blade unit 1 against his skin. As a result of the pressure that is exerted, the guide strip 6 is, as indicated by the arrow P, moved against the force of the weaker spring 12' in a direction toward the body 2, so that the guide strip 6, which in an unused state extends too far toward the front, is at the start of the shaving process and upon application of a small force first moved into the operating position in which the weaker spring 12' can no longer be compressed. This position enables a gentle shave, since a corresponding shaving angle is established. If the force or pressure is now increased, the stronger springs 12'' are compressed, thus leading to a different shaving angle to obtain a more thorough shave.

By means of the illustrated razor blade unit 1, it is thus possible due to the presence of the double spring to establish two basic shaving angles, with one shaving angle being provided for a gentle shave and the other shaving angle being provided for a more thorough shave. The establishment of the respective shaving angle is a function of the force that is applied by the user. However, in principle it is also conceivable to infinitely vary the shaving angle via a controlled application of force or pressure. The greater the pressure that is applied, the greater becomes the shaving angle.

The maximum displacement stroke is limited by stop means 13 defined by the free ends of the rearwardly directed wings 7 of the guide strip 6 as well as by the corresponding surfaces on the body 2. In addition, the upper side of the wings 7, together with a corresponding surface on the body 2, form a movement guide 14 that in the illustrated embodiment is a displacement guide. As soon as the pressure on the guide strip 6 ceases, the guide strip is shifted back into the starting position by the springs 12', 12'' in a direction opposite to that indicated by the arrow P.

Figure 4:
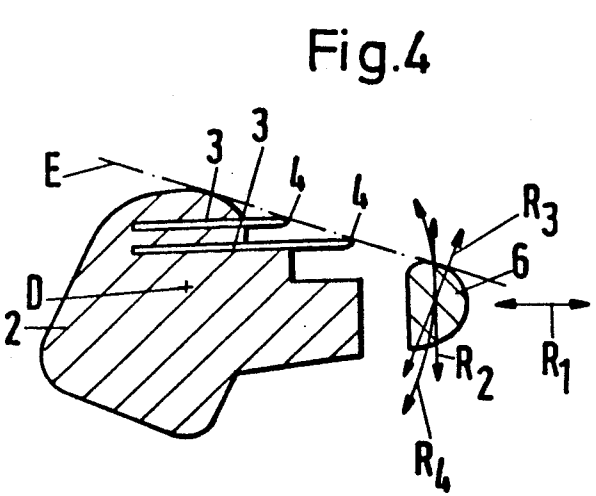
FIG. 4 is a purely schematic cross-sectional view through a razor blade unit and shows the various alternatives for the movability of the guide strip relative to the body of the razor blade unit.
Figure 3:
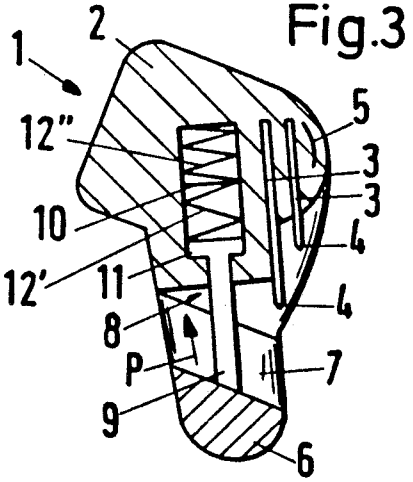
FIG. 3 is a cross-sectional view taken along the line III—III in FIG. 1.
Figure 2:
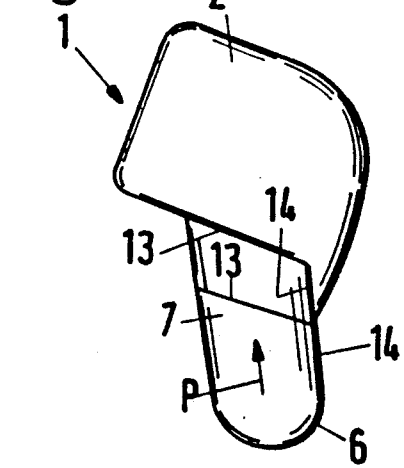
FIG. 2 is a side view of the razor blade unit of FIG. 1.

In the embodiment illustrated in FIGS. 1-3 the guide strip 6 is movable in a direction parallel to the planes of the razor blades 3. This is indicated schematically in FIG. 4 by the directional arrow $R_1$. However, other possibilities of movement for the guide strip 6 are also conceivable and are also indicated in FIG. 4.

For example, the guide strip 6 can also be moved linearly at right angles to the planes of the razor blade 3 as indicated by the directional arrow $R_2$. Another alternative is to linearly move the guide strip 6 at right angles to the connecting plane E of the two cutting edges 4 of the razor blades 3, as indicated by the directional arrow $R_3$.

Finally, a pivoting movement of the guide strip 6 is also possible. In this connection, as indicated in FIG. 4 the pivot axis D, which extends parallel to the cutting edges 4 of the razor blade 3, is disposed within the body 2. FIG. 4 also shows the pivot direction $R_4$ for this movement, which is in the form of a circular arc.

Of the illustrated alternatives for the direction of movement of the guide strip 6, the movements in the directions $R_1$ and $R_2$ are preferred.

Whereas the movement in the direction $R_4$ is a pivoting movement, the movements in the directions $R_1$, $R_2$, and $R_3$ are linear movements. However, it is also conceivable to realize the last-mentioned linear movements in the directions $R_1$, $R_2$, and $R_3$ via pivoting movements of the guide strip 6 if the pivot radius is large enough and/or the pivot angle is small enough that the pivoting movement nearly approximates a linear movement. The pivot axis D for the true pivoting movement and also for the approximately linear movement can either be disposed in the body 2, as indicated in FIG. 4, or could also be disposed at the tip of the blades.

As indicated previously, the razor head can be provided with a friction-reducing glide strip, especially one having a water soluble or insoluble polymer base. The possibility is indicated in FIGS. 1 and 3, where such a friction-reducing glide strip is shown on the body 2, and in particular in the region of the protective cover 5.

The present invention is, of course, in no way restricted to the specific disclosure of the specification and drawing, but also encompasses any modifications within the scope of the appended claims.

What I claim is:

1. In a razor head disposed at the front end of a handle of a wet razor, including a body in which is disposed a razor blade means in the form of a single or double razor blade having cutting edge means, with a guide strip that extends parallel to said cutting edge means being disposed in front of same, and with a protective cover being disposed behind said cutting edge means, the improvement wherein:

an adjustment mechanism is provided on which said guide strip, in a direction perpendicular to a lengthwise dimension of said guide strip, is disposed so as to be freely movable counter to a spring force that is effected by compound springs, each of which is a double spring that has a different spring constant and is operatively disposed between said body and said adjustment mechanism.

2. A razor head according to claim 1, in which said guide strip and said adjustment mechanism are independent of the arrangement of said razor blade means in said body.

3. A razor head according to claim 1, in which said guide strip is pivotably disposed on said adjustment mechanism with said adjustment mechanism having a pivot axis that is disposed in said body.

4. A razor blade according to claim 1 in which said spring force that is exerted upon said guide strip is effected by said compound springs, which have a first spring constant, and said guide strip is made of an elastic material having a second spring constant that differs from said first spring constant.

5. A razor head according to claim 1, which is formed by a razor blade unit where said razor blade means is fixedly embedded in said body, which is made of plastic, and said guide strip is mounted so as to be movable relative to said plastic body.

6. A razor head according to claim 1, which further comprises a friction-reducing glide strip disposed in a region of said protective cover.

7. A razor head according to claim 6, in which said glide strip has a base selected from the group consisting of water soluble and insoluble polymer bases.

8. A razor head according to claim 1, which includes stop means between said body and said guide strip.

9. A razor head according to claim 8, which includes movement guide means between said body and said guide strip.

10. A razor head according to claim 9, in which one of said stop means and said movement guide means is disposed on sides of said razor head.

11. A razor head according to claim 1, in which said guide strip is provided with at least two pins, via which said guide strip is linearly movably mounted in said body; and in which said springs are disposed in said body and are respectively supported between said body and a free, rear end of one of said pins.

12. A razor head according to claim 11, in which said guide strip is disposed on said pins such that as pressure exerted upon said guide strip increases during a shaving process, the amount by which said cutting edge means of said razor blade means projects beyond an imaginary tangential plane that rests against a top side of said guide strip and said protective cover increases and thereby the distance between said cutting edge means and a contact edge of said guide strip does not increase.

13. A razor head according to claim 11, in which said guide strip has a plane of movement that is essentially parallel to a plane of said razor blade means.

14. A razor head according to claim 11, in which said guide strip has a plane of movement that is essentially perpendicular to a plane of said razor blade means.

15. A razor head according to claim 11, in which said razor blade means is a double razor blade, and said guide strip has a plane of movement that is essentially perpendicular to an imaginary connecting plane of the cutting edges of said razor blades.

* * * * *

UNITED STATES PATENT AND TRADEMARK OFFICE

CERTIFICATE OF CORRECTION

PATENT NO. : 5,084,969

DATED : Feb. 4 1992

INVENTOR(S) : Althaus

It is certified that error appears in the above-identified patent and that said Letters Patent is hereby corrected as shown below:

[30] Foreign Application Priority Data

Sep. 2, 1989 [DE] Fed. Rep. of Germany 8910491

Signed and Sealed this

Nineteenth Day of January, 1993

*Attest:*

DOUGLAS B. COMER

*Attesting Officer*

*Acting Commissioner of Patents and Trademarks*